US008708038B2

(12) United States Patent
Tucker

(10) Patent No.: US 8,708,038 B2
(45) Date of Patent: Apr. 29, 2014

(54) PIPE GRAPPLE

(75) Inventor: Donnie C. Tucker, Lake Park, GA (US)

(73) Assignee: Donnie C. Tucker, Lake Park, GA (US)

( * ) Notice: Subject to any disclaimer, the term of this patent is extended or adjusted under 35 U.S.C. 154(b) by 371 days.

(21) Appl. No.: 13/135,273

(22) Filed: Jun. 30, 2011

(65) Prior Publication Data

US 2013/0000885 A1 Jan. 3, 2013

(51) Int. Cl.
*F16L 19/06* (2006.01)
*E21B 31/12* (2006.01)

(52) U.S. Cl.
USPC ..... 166/98; 166/364; 175/423; 285/19; 285/364

(58) Field of Classification Search
USPC ..... 166/98, 364, 360; 175/423; 285/19, 285/405, 406, 421, 364
See application file for complete search history.

(56) References Cited

U.S. PATENT DOCUMENTS

| | | | | |
|---|---|---|---|---|
| 1,944,748 | A * | 1/1934 | Leach | 165/74 |
| 2,134,311 | A | 10/1938 | Minor et al. | |
| 3,096,999 | A | 7/1963 | Ahlstone et al. | |
| 3,782,460 | A | 1/1974 | Skinner | |
| 4,722,557 | A * | 2/1988 | Bormioli | 285/18 |
| 5,031,695 | A | 7/1991 | Cain et al. | |
| 5,163,782 | A * | 11/1992 | Paulo | 405/169 |
| 5,188,483 | A | 2/1993 | Kopp et al. | |
| 5,280,823 | A * | 1/1994 | Chabot | 166/55 |
| 6,095,242 | A | 8/2000 | Lequang et al. | |
| 6,164,708 | A * | 12/2000 | Lin | 285/323 |
| 6,296,421 | B2 * | 10/2001 | Fisher | 405/224.4 |
| 7,128,143 | B2 | 10/2006 | Van Bilderbeek | |
| 7,481,269 | B2 | 1/2009 | Dallas et al. | |
| 7,740,061 | B2 | 6/2010 | Van Bilderbeek et al. | |
| 8,540,031 | B2 * | 9/2013 | Rimi | 166/364 |
| 2007/0034382 | A1 | 2/2007 | Van Bilderbeek | |
| 2011/0114391 | A1 * | 5/2011 | Scheider | 175/423 |

* cited by examiner

*Primary Examiner* — Kenneth L Thompson

(57) ABSTRACT

A grapple for controlling, monitoring and stopping the flow of oil, natural gas and the like from a broken, flanged pipe. A housing encloses a ring of material that is more ductile than the broken pipe flange. The force applied by a weight, presses a driving device against the broken pipe flange periphery, the force so applied distorts the ductile ring, thereby establishing a fluid-tight seal between the flange and the housing.

8 Claims, 5 Drawing Sheets

PIPE GRAPPLE

CROSS-REFERENCES TO RELATED APPLICATION

None

FEDERALLY SPONSORED RESEARCH OR DEVELOPMENT

None

PARTNER TO A JOINT RESEARCH AGREEMENT

None

REFERENCE TO "SEQUENCE LISTING"

None

INVENTION BACKGROUND

This invention relates to pipe grapples and, more particularly, to a device that forms a fluid-tight seal with the flange on a broken length of pipe, the grapple being lowered on to the pipe flange, driving the flange against a deformable ring within the grapple to establish a seal between the grapple and the broken pipe and lock the grapple on the flange in a fluid-tight relation in order to control flow from the broken pipe, and the like.

Pipe grapples to gain control over flow from a broken pipe proposed in the prior art have used centralizer casing segments that are pressed for frictional engagement against the outer surface of the broke pipe stem. For pipe repair purposes, these pipe grapples are not entirely satisfactory. For example, the force with which the grapple is joined to a broken section of pipe is limited to the friction force that can be applied through the centralizer segments. Accordingly, and particularly when repairing offshore oil well piping in deep water, the friction force available through the casing segments may not be sufficient to keep the grapple in place.

Clearly, there is a need for a pipe grapple that avoids this and other prior art limitations.

BRIEF SUMMARY OF INVENTION

These and other disadvantages of the prior art are overcome to a large extent through the practice of the invention to control, monitor or stop oil or natural gas flow from the broken end of a pipe.

For example, vertically movable and adjustable annular weights are provided on a grapple. These weights form an internal, centrally disposed opening.

A housing is received within the opening, the housing accommodating the end of a flanged and broken pipe stub. A recess within the housing enables the housing to encompass the broken pipe stub and the flange at the end of the broken pipe. Driving devices on the grapple press the periphery of the flange against a ring of deformable material mounted with the housing recess. Consequently, the weight of the grapple not only stabilizes the grapple on the flange, but also forces the driving device to press the flange periphery against the contacting surface of the deformable ring in order to form a fluid tight seal between the flange and the ring.

In this way, a connection can be made through the grapple with a sound length of pipe or the like to control, monitor, or stop the flow from the broken pipe. An interesting feature of the invention, moreover, relates to the grapple weight, which not only forces the deformable ring against the flange periphery, but also, as applied through the driving device, presses the flange periphery in the opposite direction against the deformable ring.

In summary, the weight of the grapple can be adjusted to bring as much force as necessary between the broken pipe flange and the softer, deformable ring to establish a satisfactory fluid seal, thus avoiding the friction force limitations that have beset the prior art.

These, and other advantages of the invention are described in more complete detail when taken with the figures of the drawing and the following description of a preferred embodiment of the invention. The scope of the invention, however, is limited only through the claims appended hereto.

DETAILED DESCRIPTION OF A PREFERRED EMBODIMENT OF THE INVENTION

Figure 1:
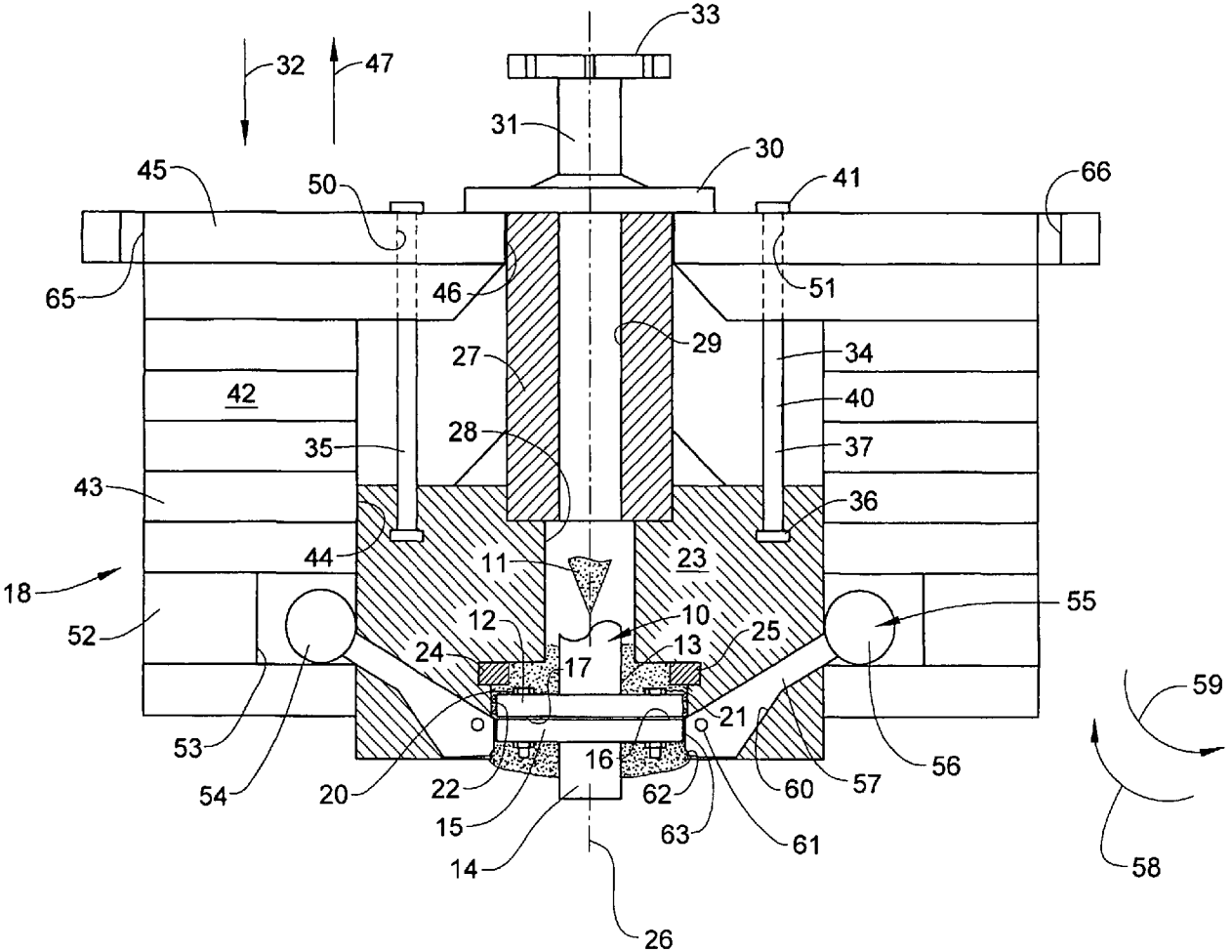
FIG. 1 is a front elevation, in full section, of a typical embodiment of the invention with the grapple in position over a broken pipe.

For a more complete appreciation of the invention, attention is invited to FIG. 1 which shows a grapple 18 for a broken pipe stub 10, from which there is an uncontrolled flow 11 of oil, natural gas and the like.

A transverse flange 12, preferably of iron or steel, is formed on end 13 of the broken pipe stub 10. A sound length of pipe 14 also terminates in another transverse flange 15. As shown in FIG. 1 opposing and matching flange surfaces 16, 17 are joined together in a fluid-tight connection by means of bolts of which only bolts 20, 21 are shown in the drawing.

The broken pipe stub 10 and the flanges 12, 15 are received in cylindrical cavity 22 formed within a housing 23. An annular ring 24, in accordance with a feature of the invention, of copper or other suitable material that is strong, but yet softer and more ductile than the material from which the flange 12 is made and having an outside diameter that is greater than the diameter of the broken pipe flange 12 is received in a corresponding recess 25 in the cylindrical cavity 22. As shown, the annular ring 24 is concentric with longitudinal axis 26 of the broken pipe stub 10, the sound pipe length 14, the flanges 12, 15 and the cavity 22. Further in this respect, the annular ring 24 although of greater outer diameter than the flange 12 nevertheless overlaps the periphery of the flange 12, the periphery being defined by the limits of the bolts 20, 21.

The housing 23 has a passageway 28 that is formed over the cavity 22 and the passage 28 is in fluid communication not only with the flow 11, but also with a further passageway 29 in a support 27 that is mounted on one end to the housing 23. A stop plate 30 is secured to the other end of the support 27.

Illustratively, the stop plate 30, in addition to limiting the travel of the housing 23 in the direction of arrow 32 also enables a short length of pipe 31 to be joined in fluid communication with the flow 11 from the broken pipe stub 10 in the cavity 22.

As shown in FIG. 1, the pipe 31 also has a transverse flange 33 to which further equipment (not shown in the drawing), of which a "blow-out preventer" or cut-off valve or a further length of sound pipe is typical, can be attached to control, monitor, or stop the undesirable flow 11 from the broken pipe stub 10.

A circular array, relative to the axis 26, of stop rods of which only stop rods 34, 35 are shown in the drawing, cooperate with the stop plate 30 to further limit the movement of the housing 23 and the support 27 in the direction of the arrow 32.

Thus, one end of the stop rod 34 has a head 36 that is of substantially greater diameter than the diameter of stop rod shank 37, the head 36 being embedded in the housing 23. The shank 37 has a remaining portion 40 that protrudes out of the housing 23 and terminates in another, large diameter head 41. The stop rod 35, and other stop rods (not shown in the drawing) have structures and functions which are the same as those attributed to the stop rod 34, described above.

In accordance with a further feature of the invention, the outer structure of the grapple 18 is assembled as a larger group of weights 42, the group of weights 42 being built up from stacked members each of predetermined weights, of which member 43 is illustrative. Thus, by assembling the group of weights 42 from the individual weights the total weight of the group 42 can be selected to provide a weight appropriate to the task of the grapple 18 as described subsequently in more complete detail.

Those weights, for example the weight 43, are provided with a centrally disposed hole 44 to accommodate the housing 23. A weight 45, however, has a smaller diameter hole 46 that enables the support 27 to travel selectively in the direction of the arrow 32 and opposite in the direction of arrow 47. A further array of holes 50, 51 also is provided in the weight 45 to accommodate the shank 37 not only for the stop rod 35 but also for the stop rod 34.

Figure 2:
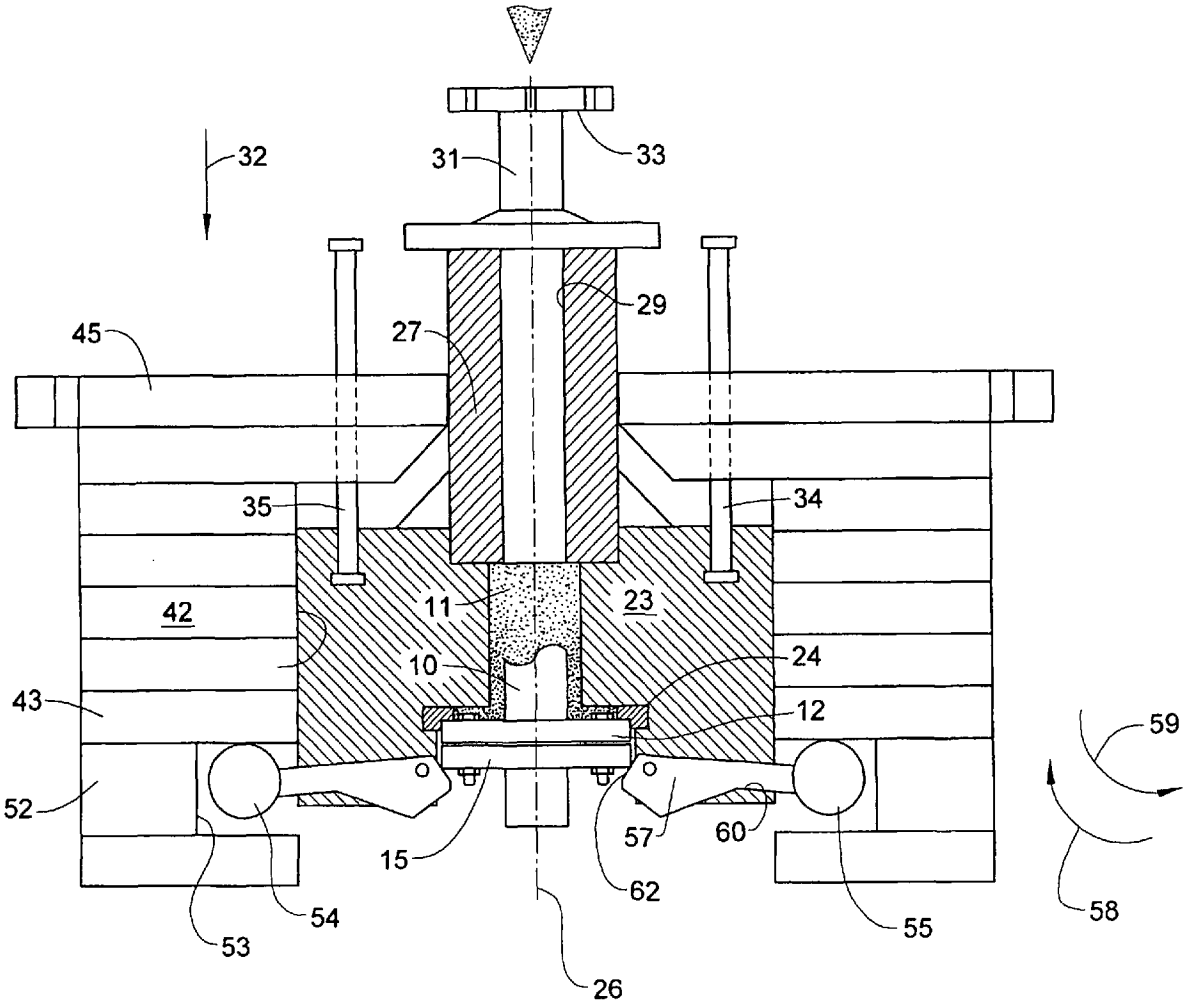
FIG. 2 is a front elevation, in full section, of the embodiment of the invention shown in FIG. 1, with the broken pipe coupled to the grapple.

Weight 52, in accordance with another feature of the invention is greater in longitudinal thickness than any of the other weights and has a further annular hole 53 that is greater in diameter than the housing 23. As shown in FIG. 1, the annular hole 53 houses a driving device 54. The driving device 54 is one of a plurality of such devices, of which only one other driving device 55 is shown in FIGS. 1 and 2 of the drawing.

One end 56 of the device 55 is a spheroid in shape, free to rotate through a limited range in that portion of the annular hole 53 occupied by the end 56. A shaft 57 extends downwardly through a passageway 60 in the housing 23 and pivots in the directions of arrows 58, 59 about a pin 61 that couples the device 55 to the housing 23. An end 62 in the shape of an arcuate cam on the device 55 protrudes from the passageway 60 and presses, in the direction of the arrow 58, against perimeter 63 of the flange 15 to selectively press the flange 12 against the deformable ring 24.

Turning once more to the group of weights 42, the weight 45 is placed over the weight group 42 and, as shown, is sandwiched between the next adjacent weight in the group 42 and the stop plate 30. Further, the weight 45 not only protrudes beyond the periphery of the other weights in the group 42, but also has an array of holes or lifting eyes 65, 66 (only two of which are shown in FIGS. 1 and 2) in the protruding portions of the weight 45. The further set of holes 50, 51 in the weight 45 also are each in their respective alignments with the stop rods 35, 34.

The lifting eyes 65, 66 are attached to cables (not shown in FIGS. 1 and 2) for raising the grapple 18 in the direction of the arrow 47 or, selectively, lowering the grapple 18 in the direction of the arrow 32. To lower the grapple 18, moreover, directly on the flange 12 and in alignment with the longitudinal axis 26 for the broken pipe stub 10, one or more messenger lines (not shown) also may be deployed through some of the holes in the lifting eyes 65, 66 array. The messenger lines preferably are attached to the sound length of the pipe 14 and act as guides not only to steady the grapple 18 as it descends in the direction of the arrow 32, but also to align the grapple 18 with the longitudinal axis 26.

The total weight for the grapple 18 should stabilize the grapple 18 in its movement in the directions of the arrows 32, 47 and also must, at a minimum, satisfy the requirement of supplying sufficient force to the flanges 12 and 15 through the driving devices 54, 55 that the ring 24 will be deformed to seal the grapple 18 and to channel essentially all of the flow 11 into the passageway 28.

In operation, and as best shown in FIG. 2, to control the flow 11 from the broken pipe stub 10, the group of weights 42, or weight package is assembled by stacking the individual weights 43, 45 so that the housing 23 fits snugly within the hole 44 formed by the annuli at the centers of the weights in the group 42. The weight 52, moreover that forms the annular hole 53 for the driving devices 54 and 55 must be placed toward the end of the stack.

Cables (not shown in FIGS. 1 and 2) seated in the respective lifting eyes 65, 66 lower the grapple 18 in the direction of the arrow 32 to seat the housing 23 over the flanges 12, 15 and in alignment with the longitudinal axis 26 in order to press the adjoining peripheral surface of the flange 12 against the deformable annular ring 24.

Although not shown in the drawing, at least some of the cables can be continued below the grapple 18 and attached to the sound pipe 14 or to some other appropriate attachment point. Thus, the cables so continued will act as "messengers" to properly align the grapple 18 with the longitudinal axis 26 (FIG. 2) of the broken pipe stub 10 and particularly, with the deformable ring 24. In this manner, the grapple 18 will be properly seated on the broken pipe flange 12.

As the grapple 18 progresses in the direction of the arrow 32 and best shown in FIG. 2, the passageway 60 for the driving device 55 forces a protruding portion of the end 62 of the device shaft 57 to pivot in the direction of the arrow 58 and wedge itself under the flange 15 in order to press the flange 12 against the deformable ring 24. In this way all of the devices 54, 55 (and other devices in the array that are not shown in FIG. 2) pivot essentially in concert against the sound pipe flange 15 to press the peripheral surface of the flange 12 against the deformable ring 24. When the housing 23 and the associated support 27 are fully seated and bearing against the broken pipe flange 12, the weight of the group 42 is sufficient to deform the annular ring 24 and form an appropriately fluid-tight seal between the peripheral surface of the flange 12 that is in contact with the ring 24.

As this contact is established the stop rods 34, 35 protrude above the weight 45. An appropriate control apparatus (not shown in the drawing) now can be connected to the flange 33 on the pipe 31 that is in fluid communication with the flow 11 from the broken pipe stub 10 and through the further passageway 29 to the pipe 31.

Thus, the flow from the broken pipe stub 10 can be stopped, monitored or controlled, as appropriate.

Figure 3:
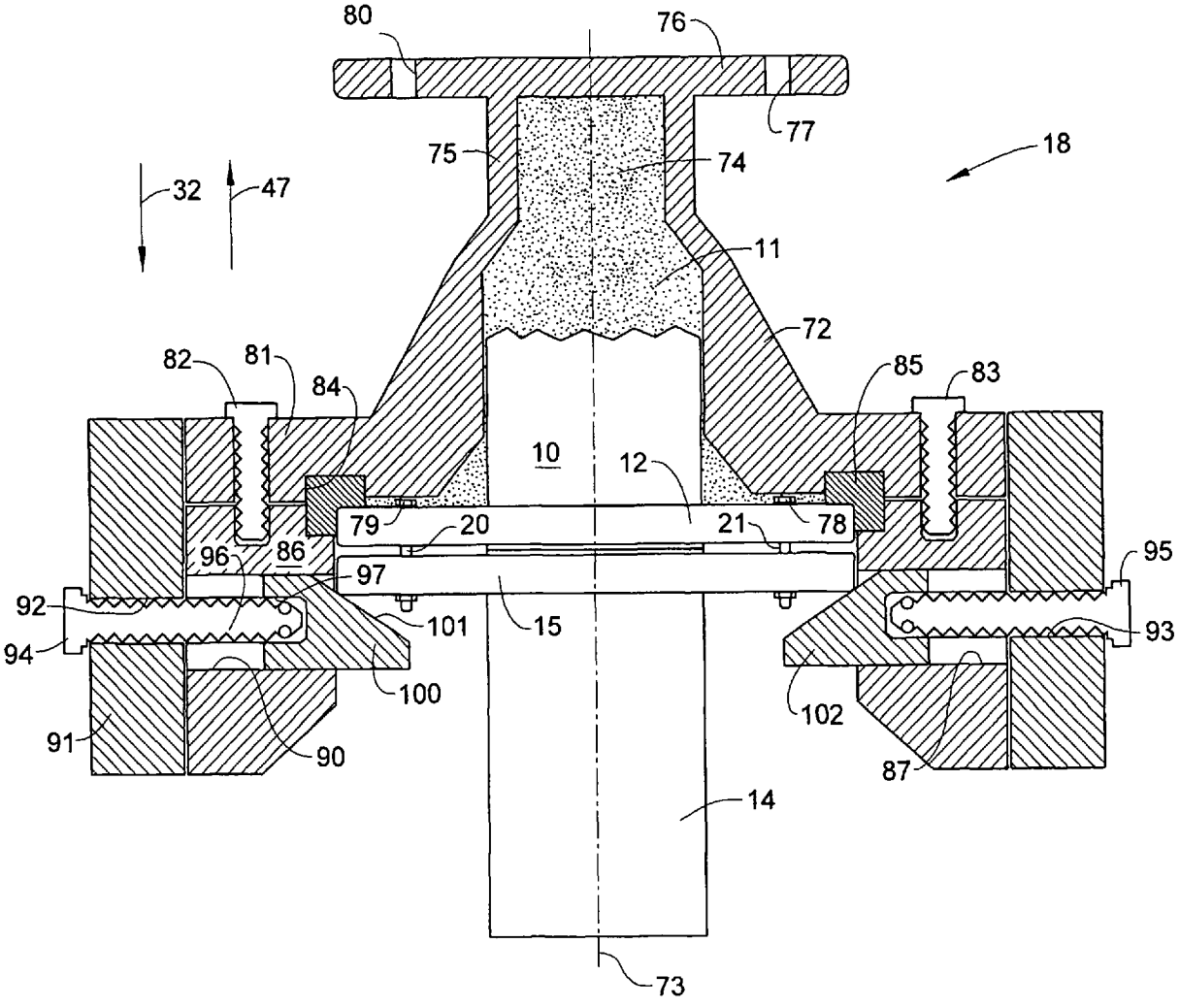
FIG. 3 is a front elevation, in full section, of another embodiment of the invention.

Attention now is invited to FIG. 3 which shows another device that employs the principles of the invention. Illustratively, the broken pipe stub 10 is enclosed by the grapple 18 which has a housing 72. Longitudinal axis 73 provides alignment not only for the broken pipe stub 10 and the transverse flange 12, but also for the housing 72 and the passageway 74 to establish fluid communication for the flow 11 from the broken pipe stub 10 through a pipe 75 on the housing 72.

Note in FIG. 3 housing pipe flange 76, integral with the housing 72, has an array of bolt holes, of which only holes 77, 80 are show in the drawing. The bolt holes 77, 80 are provided to enable a length of sound pipe, a "blow-out preventor" valve, or other suitable equipment, none of which are shown in the drawing, to be attached to the grapple 18 in order to stop, monitor or control the flow 11 from the broken pipe stub 10.

The housing 72 in provided with a transverse disk 81 that accommodates bolts 82, 83. In accordance with a feature of the invention, an annular recess 84 is formed in the disk 81 to house a deformable ring 85 of a suitably tough, resilient material (illustratively, a more ductile steel) that is, nevertheless softer and more ductile than the material of the flange 12. As illustrated in FIG. 3, the deformable ring 85, in order to bear against the opposing surface of the broken pipe flange 12, protrudes out of the annular recess 84 in the direction of the arrow 32 through a distance that is at least greater than the thickness of bolt heads 78, 79. Thereby establishing a direct physical contact between the opposing surfaces of the ring 85 and the periphery of the flange 12.

The bolts 82, 83 protrude through the longitudinal thickness of the transverse disk 81 and are each, respectively, in threaded engagement with an annular driving device support 86. Radially disposed, and transverse to the longitudinal axis 73, bores 87, 90 are formed in the driving device support 86 as illustrated in FIG. 3. Although the two bores 87, 90 shown are only two in an array of similar bores formed in the driving device support 86, which additional bores, however, are out of the plane of the drawing. The bores 87, 90 each abut a respective portion of their adjacent peripheries of the flange 15 for the length of the sound pipe 14 that is joined to the flange 12 of the broken pipe stub 10. As shown, however, the bores 87, 90 extend longitudinally below the level of the flange 15 in the direction of the arrow 32.

An annular weight 91 encloses both the driving device support 86 and the periphery of the transverse disk 81. For the embodiment of the invention shown in FIG. 3, however, the mass of the weight 91 need only be sufficient to enable the grapple 18 to settle effectively on the flange 12, the weight of the grapple 18 in this instance, being important with respect to the forces applied to the flange 12 and the deformable ring 85 as described subsequently in more complete detail.

In alignment with each of their respectively associated bores 87, 90, the annular weight 91 has a plurality of threaded bolt holes, of which only holes 92, 93 are shown in FIG. 3. Transversely disposed driving device controls, of which only threaded bolts 94, 95 are shown in FIG. 3, are threaded through their respective bolt holes 92, 93 and protrude into their associated bores 90, 87.

Illustratively, the bolt 94 has a shank 96 that protrudes into the bore 90, the shank being received in bore 97 within a wedge shaped driving device 100. The driving device 100 has an inclined plane 101 a portion of the inclined plane 101 extending under the perimeter of the sound pipe flange 15 in order to press the flange 15, and the broken pipe flange 12 to which the flange 15 is connected, in the direction of the arrow 47. Thus, in accordance with a salient feature of the invention, the peripheral portion of the flange 12 bears against the corresponding surface of the deformable ring 85 with which the periphery of flange 12 is in contact. The total mass of the grapple 18, and in particular, the mass of the annular weight 91 is such that the force applied by the grapple 18 in the direction of the arrow 32 is sufficient to enable the force applied by the driving device 100 in the opposite direction, the direction of the arrow 47 to deform the ring 85 and make a fluid-tight closure between the contacting surfaces of the ring 85 and the flange 12.

In operation, the grapple 18 is seated on the flange 12 and in alignment with the longitudinal axis 73 in the manner described in connection with the embodiment of the invention shown in FIGS. 1 and 2.

Once the grapple 18, as shown in FIG. 3 is received on the flange 12, the bolts 94, 95 (and the other similar bolts not shown in the drawing) are turned in the thread provided in their respective bores 92, 93 to advance and press the associated driving devices 100, 102 under the flange 15 in order to stress the flanges 15, 12 in the direction of the arrow 47 and cause the peripheral surface of the flange 12 to deform the engaged surface of the ring 85 and establish a suitable fluid seal that will prevent any significant portion from the flow 11 from leaking out of the housing 72. Alternatively, by turning the bolts 94, 95 in an opposite direction, the driving devices 100, 102 are withdrawn from contact with the flange 12 and are retracted back into their bores 92, 93.

The driving devices 100, 102 can be manipulated to provide a stress appropriate to deform the ring 85 and provide a fluid tight seal between the contracting surfaces of the ring 85 and the flange 12 through any conventional and safe means. For instance, divers can be employed under water to turn the bolts 94, 95. For deeper under water operations, however, it would be advisable to use transmitted images of the grapple 18 and a remotely controlled robot to manipulate the bolts 94, 95.

Figure 4:
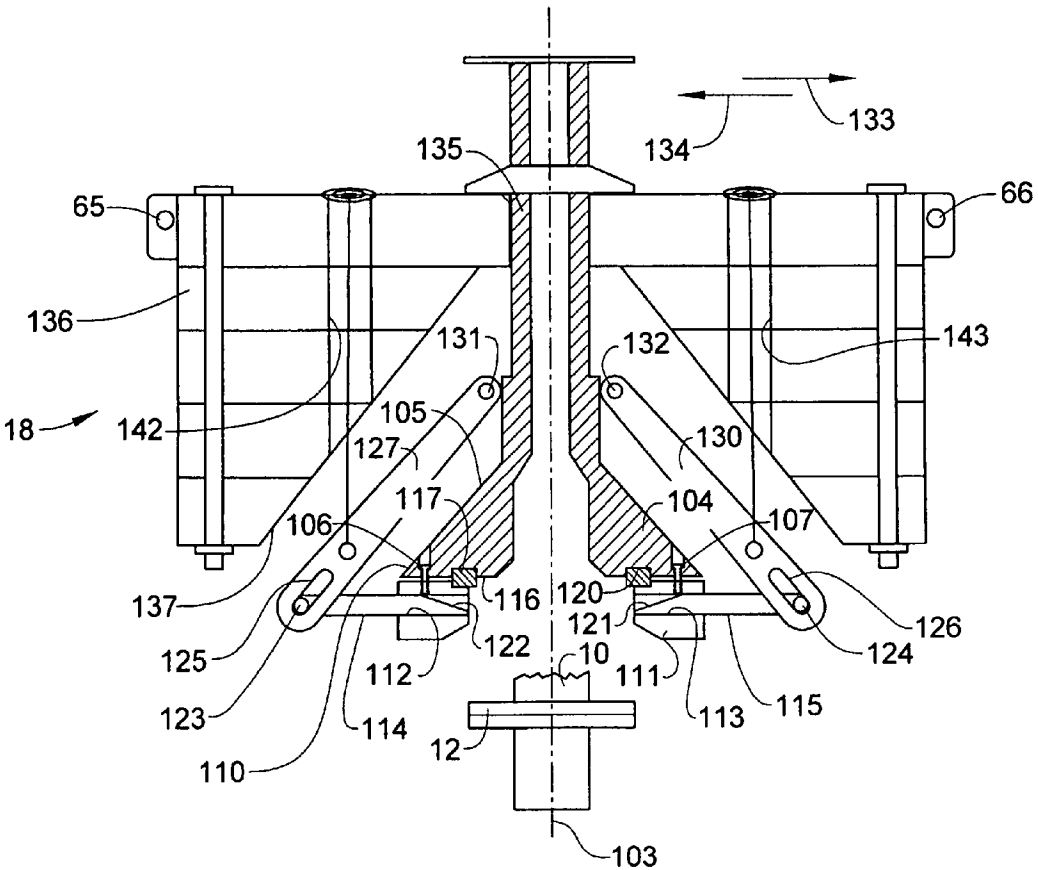
FIG. 4 is a front elevation, in full section, of a further embodiment of the invention for engaging a section of broken pipe.

Attention now is invited to a further embodiment of the invention illustrated in FIG. 4. The broken pipe stub 10 is in vertical alignment with longitudinal axis 103 for the grapple 18, the grapple 18 being aligned to be seated on the flange 12 for the broken pipe stub 10 through the lifting eyes 65, 66 in the manner described above with respect to FIGS. 1 and 2.

A housing 104 has an outer conical surface 105, also axially aligned with the longitudinal axis 103. A circular array of the bolts, of which only bolts 106, 107 are shown in FIG. 4 are received in tapped bores that are parallel with the longitudinal axis 103 and formed in periphery 110 of the conical surface 105 to support an annular driving device support 111. The driving device support 111 has an inner diameter, moreover, that is greater than the diameter of the broken pipe flange 12.

Bores 112, 113 are formed in the driving device support 111 to house driving devices 114, 115. As shown, each of the driving devices 114, 115 are mounted for transverse, radial movement toward the longitudinal axis 103 in a plane that is perpendicular to the axis 103. The driving devices 114, 115 moreover, when retracted as shown in FIG. 4 have sufficient clearance to enable the driving device support 111 to clear and encompass the broken pipe flange 12 and enable inner housing surface 116 and in particular, deformable ring 117 in recess 120 in the housing 104 to contact the opposing peripheral surface of the flange 12.

Turning once more to the driving devices 114, 115 it can be seen that inclined planes 121, 122 are formed on those surfaces of the driving devices 114, 15 that are opposite to the surface of the flange 12. On the ends of the driving devices 114, 115 opposite to the inclined planes 122, 121, however, cam followers, or articulating pins 123, 124 that are provided to engage respective cam slots 125,126 formed in associated articulating members 127, 130. As shown, ends of the members 127, 130 that are opposite to the ends that have the respective cam slots 125, 126 are provided with individual pivots 131, 132 that enable (when appropriately activated as described subsequently) the driving devices 114, 115 to move transversely and radially toward the axis 103 and in the direction of arrows 133, 134. Thus, the members 127, 130 are pivoted relative to pipe 135 in a plane that is spaced from the end of the housing 104 and above the flange 12.

Figure 5:
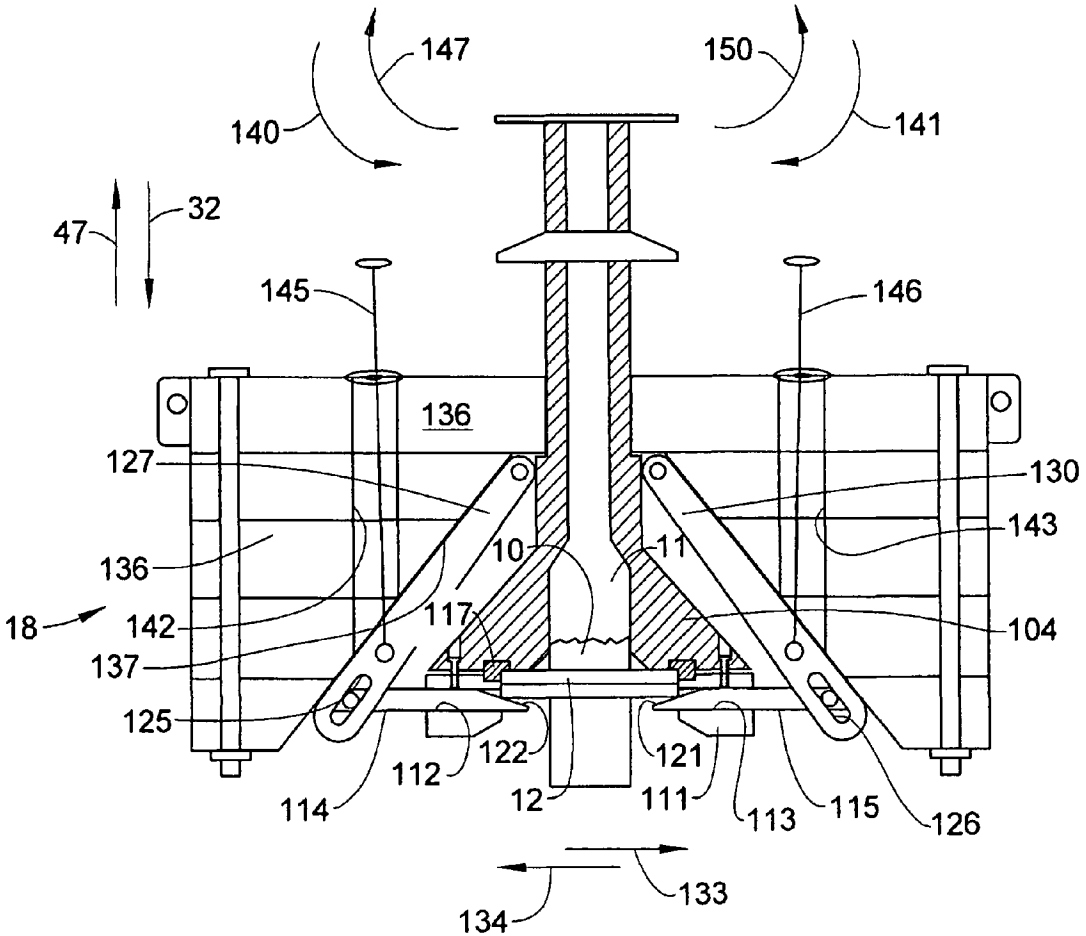
FIG. 5 is a front elevation, in full section, of the embodiment of the invention shown in FIG. 4 with the grapple mounted on a broken pipe stub.

Weights 136 as illustrated in FIG. 5 are assembled to form a conical interior 137 that corresponds in general configuration and dimensions to a condition in which the housing 104 is mounted on the broken pipe flange 12.

In operation, the conical surface interior 137 presses the members 127, 130 in the directions of respective arrows 140, 141, thereby causing the associated driving devices 114, 115 to press individually toward the flange 12 in the directions of the arrows 133, 134, respectively. So engaged, the force applied by the weights 136 in the direction of the arrow 32 pressing against the members 127, 130 is translated through the cam slots 125, 126 into movement by the driving devices 114, 115 in the direction of the respective arrows 133, 134.

So moved, the inclined planes 122, 121 on the driving devices 114, 115 press the peripheral surface of the flange 12 against the corresponding surface of the deformable ring 117 and deform the ring 117 to establish a fluid tight seal for the grapple 18. Once more, it is only necessary that the weights 136 (assembled from plates that will provide not only the weight appropriate to stabilizing the grapple while deforming the ring 17, but also to establish the conical interior 137) enabling the inclined planes 121, 122 to apply sufficient force to the flange 12 to distort the contacting surface of the deformable ring 117 and thereby to establish a fluid tight seal.

Although for most purposes, the grapple 18, when in place on the broken pipe stub 10 is likely to remain in place as long as the well is in production, there nevertheless may be a need to remove the grapple 18 when once it is in place to control, monitor or stop the flow 11 from the broken pipe. With respect to the embodiment of the invention shown in FIG. 5, to disengage and release the driving devices from contact with the flange 12, as the grapple 18 is drawn away from the flange 12 in the direction of the arrow 47, lifting members or lines 145, 146 connected to the respective members 127, 130 through bores 142, 143 that are formed in the weights 136, also are drawn in the direction of the arrow 47. This force causes the members 127, 130 to pivot in the direction of individual arrows 147, 150, thereby retracting the driving devices 114, 115 into the respective bores 112, 113 in the driving device support 111. Thus, as the driving devices 114, 115 are retracted, the driving device support 111 is able to clear the periphery of the flange 12 and permit the grapple 18 to be withdrawn from the contact with the broken pipe stub 10.

Thus, there is provided in accordance with salient features of the invention an improved grapple to apply sufficient force to the flange on a broken pipe stub to permit the flange to deform a ring and establish a fluid tight seal, the force being limited only through the weight chosen to be applied to the grapple.

What is claimed is:

1. A grapple for controlling flow from a pipe with a transverse flange having a circular periphery comprising, a housing having a cavity formed therein, said cavity having a transverse diameter that is greater than the periphery of the flange, a deformable ring within said housing having said ring overlapping the flange periphery for selective contact between said ring and the flange, said ring being formed of a material that is more ductile than the flange, at least one weight for applying a force to the flange that is sufficient to deform said ring, and at least one driving device for bearing said weight and for pressing said flange against said ring.

2. A grapple according to claim 1 wherein said driving device further comprises a spheroid shape on an end of said driving device, said spheroid shape being supported in said weight, a shaft extending from said spheroid shape and protruding from said housing, a pivot joining said shaft to said housing, a cam on said shaft protruding from said housing, said cam bearing against the flange periphery for selectively pressing the flange periphery against said ring.

3. A grapple according to claim 1 wherein said driving device further comprises a driving device support having at least one bore formed therein, said bore being radially aligned with the periphery of the flange, a driving device control in said bore, said driving device coupled on one end to said control, and an inclined plane formed on another end of said driving device for selectively pressing against the flange in response to said driving device control.

4. A grapple according to claim 3 wherein said driving device control further comprises an articulating member pivoted on one end to the grapple and having a cam slot formed in another end thereof, a cam follower coupling said driving device to said articulating member cam slot for movement therewith, said weight selectively bearing against said articulating member to press said driving device inclined plane against the flange periphery.

5. A grapple according to claim 3 wherein said driving device control further comprises a threaded bolt for advancing and retracting the driving device relative to the flange and said bore.

6. A grapple according to claim 4 wherein said weight further comprises an interior surface that bears against said articulating member enabling said cam follower to press said driving device against the flange periphery.

7. A grapple according to claim 6 further comprising at least one lifting member attached to said articulating member for relieving said weight from said driving device and to retract said driving device from the flange.

8. A grapple according to claim 1 wherein said weight comprises several weights of predetermined values, said weights assembled into a combination of weights that have a hole formed in the interior to encompass said housing, and a support in fluid communication with the flow from the pipe within said hole.

* * * * *